United States Patent [19]

Sauer

[11] 4,425,687

[45] Jan. 17, 1984

[54] SAFETY CLASP FOR JEWELRY

[75] Inventor: Alfred E. Sauer, Warwick, R.I.

[73] Assignee: B. A. Ballou & Co., Incorporated, Providence, R.I.

[21] Appl. No.: 204,389

[22] Filed: Nov. 5, 1980

[51] Int. Cl.[3] ..... A44B 11/26

[52] U.S. Cl. ..... 24/664; 63/12

[58] Field of Search ..... 24/230 R, 230 AK, 230 AL, 24/217 R, 110, 155 BR, 155 CC; 63/12, 13

[56] References Cited

U.S. PATENT DOCUMENTS

| | | | |
|---|---|---|---|
| 2,288,990 | 7/1942 | Bryce | 24/110 |
| 2,882,581 | 4/1959 | Spielman | 24/230 R |
| 3,252,196 | 5/1966 | Ries | 24/230 AL |
| 3,523,339 | 8/1970 | LaViano | 63/12 X |

FOREIGN PATENT DOCUMENTS

| | | | |
|---|---|---|---|
| 804853 | 11/1936 | France | 63/12 |
| 1101361 | 10/1955 | France | 63/12 |

*Primary Examiner*—Robert P. Swiatek

*Attorney, Agent, or Firm*—William Frederick Werner

[57] ABSTRACT

This invention relates to safety clasp for jewelry such as necklaces, bracelets, earrings, tie tacks, hat pins and the like, and more particularly, to a clasp for jewelry including releasably connected male and female components, generally flat in one dimension. The male component comprises a flat shaped tongue. The female component comprises a tongue guide provided with a groove in which the tongue is slidably mounted. A spring lock release with a tab projecting through a groove for engagement and disengagement with a notch in the tongue. The foregoing elements are housed in a two-part shell fastened together in final assembly.

4 Claims, 16 Drawing Figures

FIG. 1
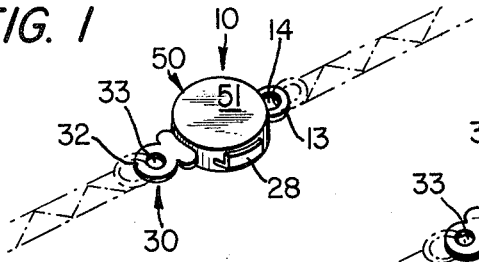
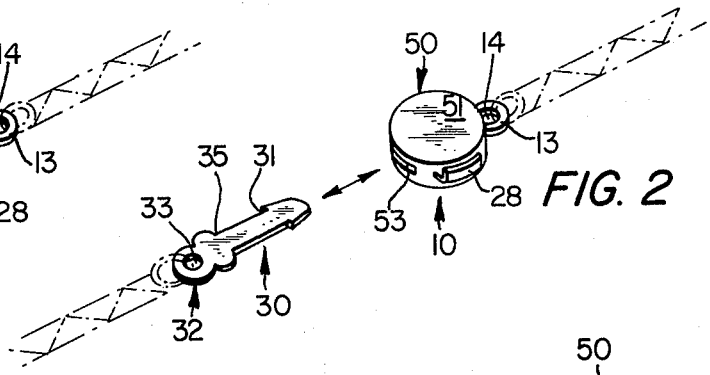
FIG. 2
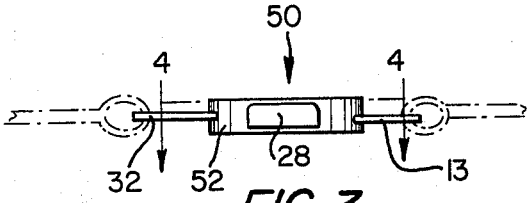
FIG. 3
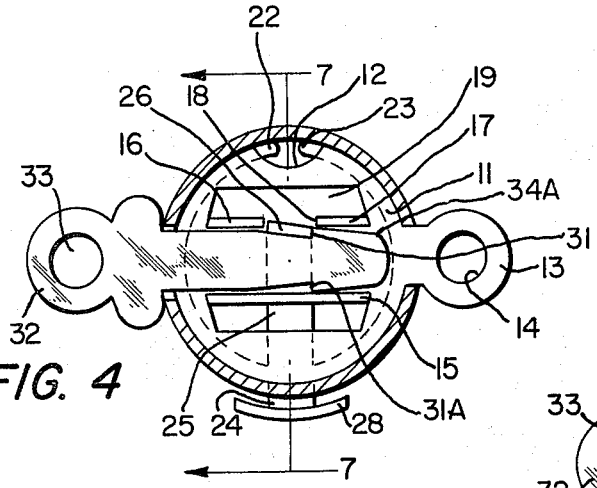
FIG. 4
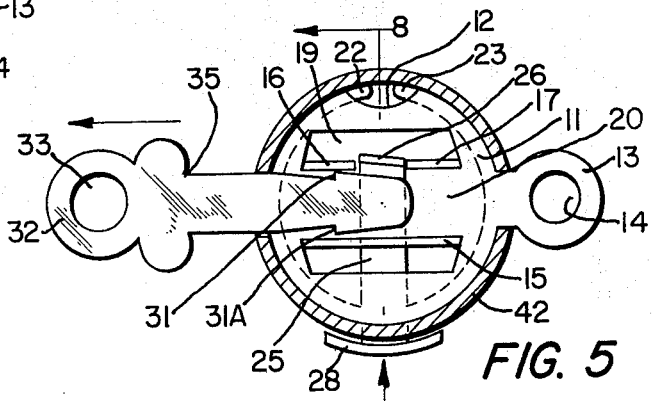
FIG. 5
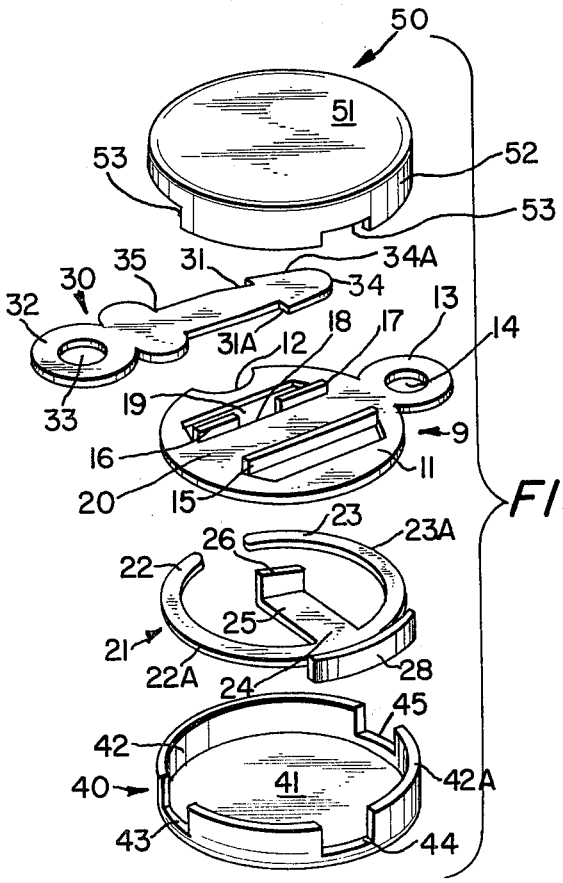
FIG. 6
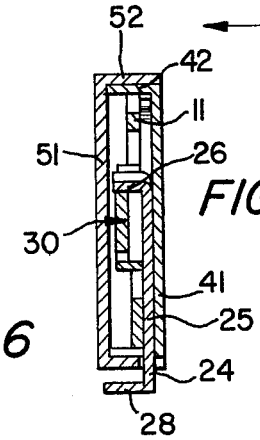
FIG. 7
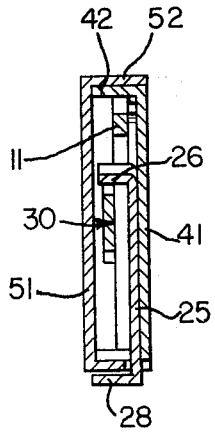
FIG. 8

FIG. 9
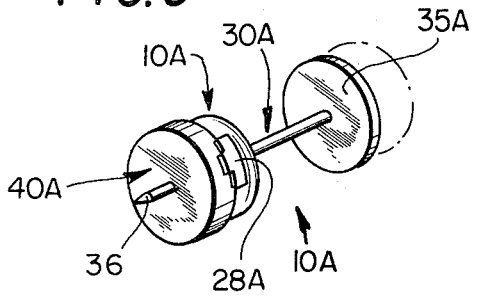
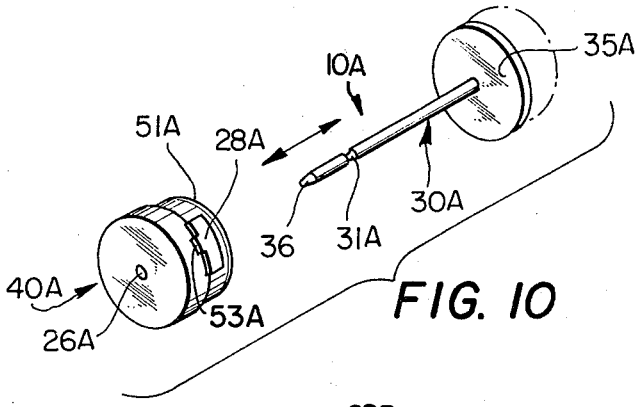
FIG. 10
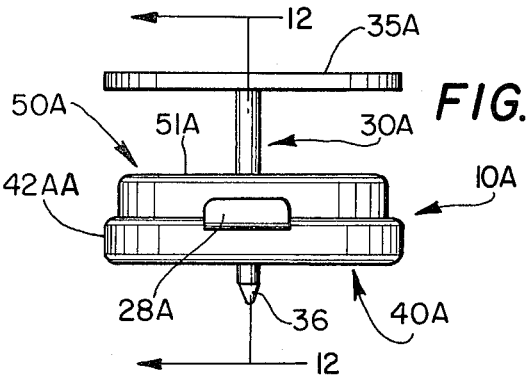
FIG. 11
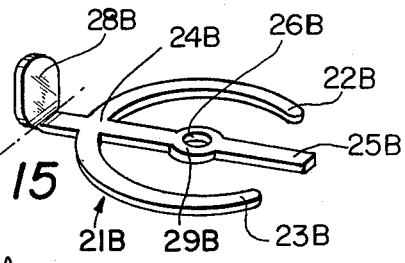
FIG. 15
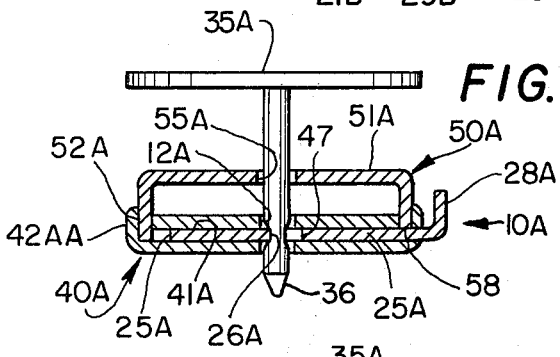
FIG. 12
FIG. 13
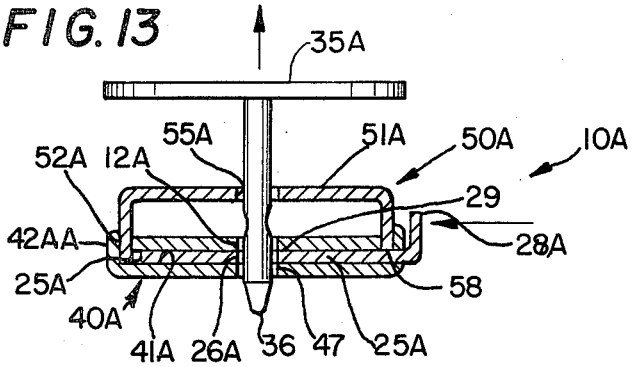
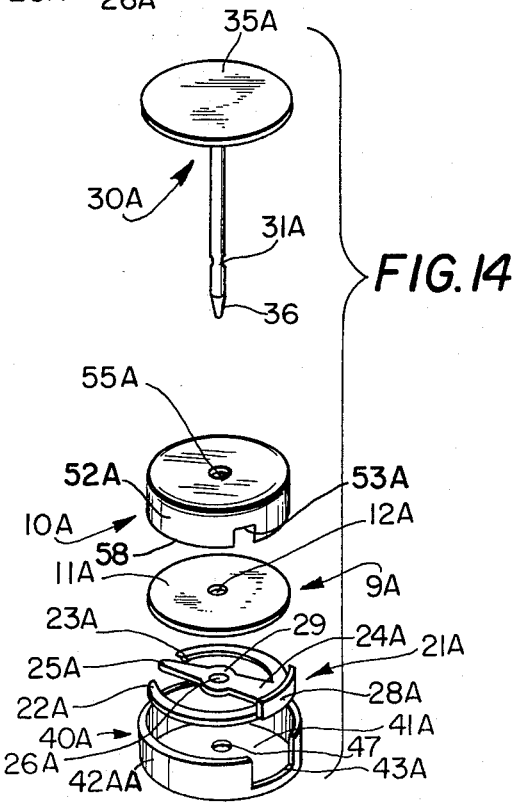
FIG. 14
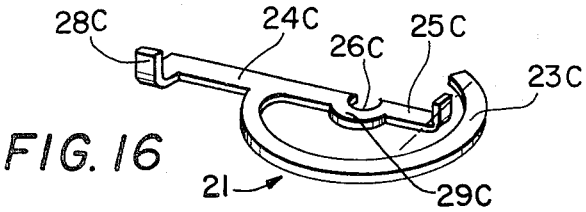
FIG. 16

SAFETY CLASP FOR JEWELRY

STATEMENT OF INVENTION

This invention relates to safety clasps for jewelry and more particularly to clasps constructed of very few, light weight, tiny in size, punch press parts for economy of manufacture.

BACKGROUND OF THE INVENTION

The present invention relates as indicated to a fastening device which can be attached to an article of jewelry. As such, it must be extremely small and easily manipulated into gripping and non-gripping position by manual dexterity of the finger nails or finger tips. It must therefore be quickly and easily operated and be positive and foolproof in gripping or clasp position.

PRIOR ART

Prior art devices are disclosed in U.S. Pat. Nos. 4,195,391; 4,184,343; 3,947,930; 989,372; 298,987; 237,985; 218,864 and 202,684. These prior art disclosures lack consideration as to the tiny size needed in ornamental jewelry or they constitute many parts requiring expensive manufacturing procedures or they lack positive safety locking features.

SUMMARY OF THE INVENTION

It is an object of the present invention to provide a novel, fast, and effective way of preventing the loss of a necklace, bracelet and the like, while retaining an esthetic appearance; which prevention is of special importance when the necklace, et al, are provided with diamonds or other expensive gems or precious metal.

It is another object of the present invention to provide a simple, positive acting, ornamental appearing, inexpensive to manufacture clasp suitable for use with expensive necklaces, bracelets, earrings, and the like.

Another object of the present invention is to provide an attractive yet safe device of simple construction, adaptable to fabrication from various materials for a minimum of light weight, and capable of being provided in various suitable finishes, in different sizes and in a great variety of shapes.

Still another object of the present invention is to provide a safety clasp capable of securing an earring at any point on the post of the earring, thereby making adjustment possible for different thicknesses of ear lobes.

Other objects of the present invention will become apparent in part and be pointed out in part in the following specification and claims.

BRIEF DESCRIPTION OF THE DRAWINGS

FIG. 1 is a perspective view of the new and improved safety clasp for jewelry, shown in locked position, and enlarged many times;

FIG. 2 is a view similar to FIG. 1, showing the safety clasp in open position;

FIG. 3 is a front elevational view of FIG. 1; FIG. 4 is a horizontal cross sectional view taken on line 4—4 of FIG. 3, showing the clasp in closed or locked position;

FIG. 5 is a view similar to FIG. 4 showing the clasp in open or unlocked position;

FIG. 6 is an exploded perspective veiw showing the several parts which constitute the new and improved safety clasp;

FIG. 7 is a vertical sectional view taken on line 7—7 of FIG. 4;

FIG. 8 is a vertical sectional view taken on line 8—8 of FIG. 5;

FIG. 9 is a perspective view of a modified form of safety clasp, shown in locked position;

FIG. 10 is a view similar to FIG. 9 showing the safety clasp in open position;

FIG. 11 is a side elevational view of FIG. 9;

FIG. 12 is a vertical cross sectional view taken on line 12—12 of FIG. 11 showing the clasp in closed position;

FIG. 13 is a view similar to FIG. 12 showing the safety clasp in open position;

FIG. 14 is an exploded perspective view showing the several parts which constitute the modified form of construction;

FIG. 15 is a perspective view of a modified form of spring lock and release;

FIG. 16 is a perspective view of still another modified form of spring lock and release.

Referring to the drawings, the new and improved safety clasp for jewelry, generally indicated in reference numeral 10, comprises a tongue guide generally indicated by reference numeral 9, consisting of a flat, wafer type body 11 provided with window 12, a ring neck 13 provided with an opening 14, an upstanding wall 15 forced out of body 11 and two ears 16, 17 forced out of body 11 and thereby providing an opening 19 and a slot 18 between said two ears. Wall 15 and ears 16, 17 provide a guideway 20 between them.

A spring lock and release generally indicated by reference numeral 21 consists of two arcuate legs 22, 23 united at a base area 24 from which projects an arm 25 having a tab 26 on one end and a spring release thumb 28 on the other end. Spring lock and release 21 is fabricated from flat spring or resilient material.

A tongue generally indicated by reference numeral 30 is fabricated from flat material provided with a step 31 in one side and ring 32 having an opening 33 on one end. The opposite end 34 may have any geometric shape but is shown as a rounded end for convenience of manufacture. A shoulder 35 may be provided with an insertion stop as will presently appear. A second step 31A may be provided so that flat tongue 30 may be positioned in guideway 20 with either side presented to tab 26.

A bottom shell generally indicated by reference numeral 40 consists of a back 41 circular in configuration having a circular wall 42 provided with three notches 43, 44 and 45.

A cover generally indicated by reference numeral 50 consists of a top 51 circular in configuration having a circular depending skirt 52 provided with notched openings 53 equal in number to notches 43, 44, 45 and aligned with them in final assembly.

In assembling the several parts spring lock release 21 is placed in bottom shell 41 with a section of leg 25 lying in notch 44 so that spring release thumb 28 projects outside of circular wall 42 and base area 24 abuts the inside of circular wall 42 with the medial sections 22A, 23A of arcuate legs 22, 23 slidably engaging the inside of circular wall 42. Tongue guide 9 is placed over spring lock release 21 with ring neck 13 aligned with notch 45 and with tab 26 in opening 19 and aligned with slot 18. Tongue guide 9 is laid upon spring lock release 21. Tongue 30 is aligned with notch 43 and guideway 20 and is laid upon tongue guide 9. FIG. 5 illustrates the position of the several parts as described. Tongue 35 is in unlocked position. Top shell 50 is placed over bottom shell 40 with notches 53 aligned respectively with notches 43, 44 and 45 and with skirt 52 encasing circular wall 42. The top edge 42A of wall 43 engages the inner surface of top 51. Means, such as spot welding or soldering or an adhesive fasten skirt 52 to circular wall 42.

In operation tongue 30 is slidably mounted in guideway 20 so that movement of tongue 30 from unlocked position shown in FIG. 5 to locked position shown in FIG. 4 causes step 31 to be aligned with tab 26. Arcuate spring legs 22, 23 yieldingly engaging circular wall 42 position tab 26 in slot 18 and also projecting into guideway 20. Side 34 A forces tab toward opening 19 as tongue 30 slides into guideway 20 until step 31 is aligned with tab 26 whereupon tab 26 snaps into step 31 to positively lock tongue 30 within the casing comprising top shell 50 united with bottom shell 40. Shoulder 35 limits the extent tongue 30 may be slid into guideway 20 by abutting skirt 52. Manual pressure on spring release thumb 28 slidably moves spring lock release 21 inwardly of the casing, moving tap 26 out of engagement with step 31 thereby permitting tongue 30 to be withdrawn from guideway 20 and casing.

FIGS. 1 and 2 illustrate a jewelry chain in dot and dash lines having opposite ends fastened to ring neck 13 and ring 32, respectively.

Reference is now made to FIGS. 9, 10, 11, 12, 13 and 14 wherein is shown a modified form of construction relating to the new and improved safety clasp for jewelry, generally indicated by reference numeral 10A.

Clasp 10A comprises a bottom shell 40A having a back 41A circular in configuration and a circular wall 42AA provided with a notch 43A and an orifice 47.

A spring lock release generally indicated by reference numeral 21A consists of two arcuate legs 22A, 23A united at a base area 24A from which projects an arm 25A on one end and a spring release thumb 28A on the other end. Spring lock release 21A is fabricated from flat resilient material. Arm 25A is provided with a port 26A having a locking shoulder 29.

A tongue guide generally indicated by reference numeral 9A comprises a flat, wafer type body 11A provided with an axial passageway 12A.

A cover generally indicated by reference numeral 50A consists of a top 51A circular in configuration and provided with a circular depending skirt 52A, a bore 55A and a notch opening 53A.

A tongue post generally indicated by reference numeral 30A is provided with a step or groove 31A and a button 35A which may be of ornamental configuration serving as an earring, and a tapered circular end 36.

In assembling the several parts of the modified form, spring lock release 21A is placed in bottom shell 40A with base area 24A located in notch 43A thereby placing spring release thumb 28A outside of wall 42AA while medial portions or arcuate legs 22A, 23A slidably engage the inside of circular wall 42AA. Tongue guide 21A is placed upon spring lock release 9A. Circular depending skirt 52A embraces tongue guide 9A and spring lock release 21A with notch opening 53A aligned with notch 43A and with the end wall 58 resting upon back 41A. Circular wall 42AA embraces skirt 52A and is clinched against skirt 52A to provide a unitary structure wherein bore 55A, axial passageway 12A, port 26A and orifice 47 are in axial alignment when spring lock release 21A is in open position as shown in FIG. 13. Spring lock release is slidably mounted between tongue guide 9A and back 41A. In this open condition tongue post 30A may pass through bore 55A, axial passageway 12A, port 26A and orifice 47 as seen in FIG. 13. Sliding spring release thumb 28A away from wall 42A will cause shoulder 29 to engage step 31A thereby locking post 30A to spring lock release 21A.

With reference to FIGS. 12 and 13, FIG. 13 shows bore 55A, axial passageway 12A, port 26A and orifice 47 in axial alignment with the end of arm 25A spaced from skirt 52A. In FIG. 12 bore 55A, axial passageway 12A and orifice 47 are axially aligned but port 26A is axially misaligned in locking position with shoulder 29 engaging groove 31A. Assuming port 26A is misaligned with tongue post 30A withdrawn from cover 50A. Then if post 30A' is inserted into cover 50A and through bore 55A and axial passageway 12A, tapered circular end 36 will engage port 26A and axially align port 26A with axial passageway 12A and orifice 47. It will be further noted that manual pressure at spring release tuumb 28A, forcing arm 25A toward circular wall 42AA will result in spring release thumb 28A engaging circular wall 42AA before the end of arm 25A engages skirt 52A. This is a safety feature to prevent over fatigue of spring legs 22A, 23A.

With reference to FIGS. 15 and 16, wherein is shown two different modified forms of spring lock 21A shown in FIG. 6, FIG. 15 consists of two arcuate legs 22B, 23B united at a base area 24B from which an arm 25B projects in one direction and a spring release thumb 28B extends in an opposite direction. A port 26B located in arm 25B is provided with a locking shoulder 29B arranged to engage and disengage step 31A. Spring lock release 21B is fabricated from flat resilient material to allow legs 22B, 23B to resiliently engage the rear side of outside wall 42AA.

FIG. 16 consists of one arcuate leg 23C attached to a base area 24C from which an arm 25C projects. An opening 26C is located in arm 25C. A shoulder 29C surrounds opening 26C. A spring release thumb 28C extends from the outer end of base area 24C. Spring lock release 21C is fabricated from flat resilient material and functions in the same manner as described for spring lock release 21B.

Having shown and described preferred embodiments of the present invention by way of example, it should be realized that structural changes could be made and other examples given without departing from either the spirit or scope of this invention.

What I claim is:

1. A safety clasp for jewelry comprising a circular shaped casing having an inner wall and a first notch opening, a second notch opening, and a third notch opening, a spring lock release having two arcuate legs, an arm provided with a tab, and a spring release thumb, said spring lock release located within said casing with said two arcuate legs yieldingly engaging said inner wall and with said spring release thumb projecting outwardly through said second notch opening, a tongue guide, positioned above said spring lock release, provided with a ring neck, an upstanding wall, two ears, a slot between said two ears, an opening and a guideway provided between said upstanding wall and said two ears, said tab located between said two ears in said slot and movable into said opening, with said ring neck projecting through said third notch opening, a tongue having a ring and a step, said tongue slidably mounted in said guideway and projecting through said first notch opening and with said step aligned with said tab for engagement and disengagement therewith through the manual manipulation of said spring release thumb.

2. A safety clasp for jewelry as set forth in claim 1 wherein said spring lock release, said tongue guide and said tongue are fabricated from flat material.

3. A safety clasp for jewelry comprising a hollow circular shaped casing (generally circular in one dimension and generally flat in an opposition dimension) having a flat top and bottom, said casing having an inner wall and a first notch opening, and a second notch opening, a spring lock release fabricated from flat resilient material and having a tab located within said hollow casing, a tongue guide fabricated from flat material, positioned upon said spring lock release within said casing and provided with a slot and a guideway, said tab slidably mounted in said slot, a tongue, having a step fabricated from flat stock and slidable in said guideway with said step engageable and disengageable with said tab, means for manually moving said spring lock release back and forth in said casing through said second notch opening, a second manual means for moving said tongue back and forth in said casing through said first notch opening, (and a third) fastening means for attaching a jewelry chain to said casing.

4. A safety clasp for jewelry comprising a tongue guide consisting of a flat body having a ring neck, an upstanding wall, two ears, a slot between said two ears and an opening, said wall and said two ears providing a guideway there between, a spring lock release, fabricated from resilient material, comprising two arcuate legs united at a base area, an arm, having a tab, projecting from said base area and a spring release thumb projecting from said base area in a direction opposite from said tab, a flat shaped tongue provided with a step, a ring on one end and a rounded end on the opposite end, a bottom shell comprising a back having a circular wall and a first notch, a second notch and a third notch, a cover having a circular depending skirt provided with a first notch opening, a second notch opening and a third notch opening, said spring lock release located in said shell with said spring release thumb projecting from said second notch with said two arcuate legs yieldingly engaging said circular wall, said tongue guide located upon said spring lock release with said tab positioned in said slot, said tongue located in said first notch and positioned in said guideway with said step aligned with said tab for resilient engagement therewith, and said top shell placed over said bottom shell with said first notch opening aligned with said first notch, said second notch opening aligned with said second notch, and said third notch opening with said third notch, and means fastening said top shell to said bottom shell.

* * * * *